US007114290B2

(12) United States Patent
Stubbe

(10) Patent No.: US 7,114,290 B2
(45) Date of Patent: Oct. 3, 2006

(54) VEHICLE ACTUATED GATE OPENING/CLOSING SYSTEM

(75) Inventor: Bernhard Stubbe, Russell (NZ)

(73) Assignee: Innovative Engineering Solutions Limited, Northland (NZ)

( * ) Notice: Subject to any disclaimer, the term of this patent is extended or adjusted under 35 U.S.C. 154(b) by 0 days.

(21) Appl. No.: 10/794,598

(22) Filed: Mar. 8, 2004

(65) Prior Publication Data

US 2004/0237408 A1 Dec. 2, 2004

Related U.S. Application Data

(63) Continuation of application No. PCT/NZ02/00109, filed on Jun. 12, 2002.

(30) Foreign Application Priority Data

Aug. 8, 2001 (NZ) ..... 513399

(51) Int. Cl.
*E05F 13/02* (2006.01)

(52) U.S. Cl. ..... 49/274; 49/272; 49/279; 49/236; 49/237

(58) Field of Classification Search ..... 49/263, 49/272, 273, 274, 268, 267, 281, 279, 286, 49/288, 293, 302, 333, 338, 347, 236, 237, 49/239, 49

See application file for complete search history.

(56) References Cited

U.S. PATENT DOCUMENTS 250,424 A * 12/1881 Cobb ..... 110/178
253,810 A * 2/1882 Zentmyer ..... 49/237
893,022 A * 7/1908 Siedle ..... 49/238
1,146,716 A * 7/1915 Kirch ..... 49/237
1,424,913 A * 8/1922 Kahler ..... 49/237
1,684,578 A * 9/1928 Edwards ..... 49/237
1,729,187 A * 9/1929 Rose ..... 49/237
1,759,649 A * 5/1930 Lebherz ..... 16/84
2,062,738 A * 12/1936 Bigler ..... 49/241
2,086,061 A * 7/1937 Barr ..... 49/237
RE24,059 E * 9/1955 Pinion et al. ..... 16/318
2,799,103 A * 7/1957 Warren ..... 49/237
3,429,074 A * 2/1969 Horton ..... 49/286
3,435,557 A * 4/1969 Johnson ..... 49/70
3,714,736 A * 2/1973 Weaver ..... 49/237
4,026,069 A * 5/1977 Bohnett ..... 49/49
4,458,448 A * 7/1984 Proulx ..... 49/237
4,521,992 A 6/1985 Campbell (Continued)

FOREIGN PATENT DOCUMENTS

DE 3632673 A1 4/1988

(Continued)

OTHER PUBLICATIONS

Derwent Abstract Acces. No. 84-217781/35, SU 1063976A, (Yachmonin) , Dec. 30, 1983.

*Primary Examiner*—Gregory J. Strimbu
(74) *Attorney, Agent, or Firm*—Jacobson Holman PLLC

(57) ABSTRACT

A gate opening system which includes a barrier and a barrier mounting adapted to mount the barrier in an open or closed condition, a retention device to secure the barrier in an open or closed condition, a drive element, and an energy transmission system, whereby energy is transferred from the weight of a vehicle and is in turn transmitted through the transmission system to rotate the drive element, causing the barrier mounting to be lifted, the disengagement of the retention device, and the barrier thereby opened or closed.

5 Claims, 4 Drawing Sheets

U.S. PATENT DOCUMENTS 4,662,111 A * 5/1987 Romberg ..... 49/364
4,667,440 A * 5/1987 Grace, Sr. ..... 49/237
5,050,344 A * 9/1991 Skeem ..... 49/237
5,469,660 A * 11/1995 Tamenne ..... 49/192
5,471,708 A * 12/1995 Lynch ..... 16/66
6,091,217 A * 7/2000 Parsadayan ..... 318/285
6,408,571 B1 * 6/2002 Trott ..... 49/263

FOREIGN PATENT DOCUMENTS

DE 3638384 A1 5/1988
WO WO79/00232 5/1979

* cited by examiner

VEHICLE ACTUATED GATE OPENING/CLOSING SYSTEM

This is a continuation of PCT/NZ02/00109 filed Jun. 12, 2002 and published in English.

TECHNICAL FIELD

This invention relates to an improved opening and/or closing system for a gate. Preferably the present invention may provide a gate opening system which does not require the supply of energy from any form of storage system (other than for example, timing or other low power usage non gate movement drive purposes) to drive the mechanisms used to open and close a gate.

BACKGROUND ART

Gates are commonly used to provide a moveable barrier to close an opening in a wall or a fence. Gates allow access to an enclosed area to authorised persons and can be used (for example) to secure vehicles, property or livestock.

In instances where a gate closes a vehicle entrance, a vehicle operator must normally leave their vehicle to open the gate, return to their vehicle to move it though the opening formed, return to the gate to close it and then continue on their way in their vehicle. This can become an annoying chore for the vehicle operator particularly when they must pass through several gates on their journey or frequently need to pass through the same gate.

It would therefore be of advantage to have a gate opening system which could be operated or actuated from within or on a vehicle and which could also preferably close the gate after the vehicle has moved past the gate.

Some relatively complicated gate or door opening systems have been developed to address this requirement. For example, it is know to provide a gate or (for example) a garage door linked to an electro-mechanical actuation system which drives a gate or door open or closed upon receipt of a radio frequency transmission, or the entry of a control code into a key pad. However, these systems are normally only found in urban settings where gate opening systems can readily be connected to mains power electrical energy. Furthermore, the electro mechanical systems employed are also relatively complicated and costly to implement and to maintain over time.

This type of approach is also not practical in rural applications. For example, a single farm may include a number of gates, all of which are scattered throughout remote locations on a property. To obtain free access to all areas of the property a vehicle operator may have to pass through several gates to arrive at their destination. In such instances the locations of the gates limits the availability of power sources for a gate opening system. In these cases it is not feasible to run power transmission lines out to a gate opener, nor to provide a high demand power supply battery based storage system which would need to be replaced or recharged frequently.

It would be of advantage to have a gate opening system which required for gate movement between the closed and opened conditions, and vice versa, no external power supply nor relied on a power supply which needed to be recharged or refreshed periodically. Furthermore, a gate opening system with a relatively simple mechanical design which could therefore be manufactured and maintained easily and inexpensively would be of advantage.

OBJECT OF THE INVENTION

It is an object of the present invention to address the foregoing problems or at least to provide the public with a useful choice.

Further aspects of the present invention will become apparent from the ensuing description that is given by way of example only.

SUMMARY OF INVENTION

According to one aspect of the present invention there is provided a gate opening system which includes or comprises,

- a barrier mounting adapted to mount a barrier in an open or closed position, and
- a retention means adapted to secure a barrier in an open or closed positions, and
- a drive element, and
- an energy transmission system, said energy transmission system adapted to apply a rotational force to the drive element, whereby rotation of the drive element causes the barrier mounting to be lifted and the retention means to disengage.

Preferably the energy transmission system receives energy sourced from the weight of a vehicle depressing a portion of the energy transmission system.

Preferably disengaging the retention means allows the barrier mounting to fall and move the mounted barrier to an open position.

Preferably there includes a return system adapted to move the barrier mounting and associated barrier to a closed position without lifting the barrier mounting.

Preferably the gate opening system can be triggered or operated by a user from within the confines of a vehicle.

Preferably the gate opening system may automatically open the gate for a vehicle, and then after a set delay period (which allows the vehicle to pass the gate), the system may close and secure the gate again.

Preferably the gate opening system may be either retrofitted to an existing gate assembly, or alternatively may be incorporated into an entirely new gate assembly.

Preferably the barrier mounting is adapted to mount a barrier in an open or closed position. Preferably the barrier to be mounted may provide the gate portion to be opened or closed by the system, where the form, shape or configuration of the barrier will be determined by the dimensions of the area to be closed by the gate.

Preferably the barrier mounting means is adapted to allow the barrier mounted to move between opened or closed positions through changing the orientation or configuration of the barrier mount with respect to other components of the system. Reference to the barrier mount and the barrier itself being placed in open or closed positions or configurations will also be used interchangeably throughout this specification.

Preferably the energy transmission system is adapted to supply the energy requirements of a gate opening system and provide the motor power required to move the mounting barrier between opened and closed configurations.

Preferably the gate opening system further includes at least one drive element where a drive element is adapted to be rotated by a component or portion of the energy transmission system so that the drive element will in turn cause the barrier mounting to be lifted.

In a further preferred embodiment the present invention may include a single drive element only. The gate opening system may be adapted to employ a single drive element only in preferred embodiments, limiting the complexity and the materials costs involved with constructing such a system. However those skilled in the art should appreciate that more than one drive element may be employed if required in other embodiments.

Preferably the gate opening system may also include a retention means which is adapted to secure the barrier in an open and/or closed position. For example, in a preferred embodiment a retention means may be employed to ensure that livestock cannot easily push the barrier into an open position. Alternatively in another embodiment the retention means may be employed to ensure that unauthorised persons cannot move the barrier from a closed to opened position.

In a preferred embodiment when the gate opening system is operated to placed the barrier in an open position, the energy transmission system may rotate the drive element which will in turn lift the barrier mounting.

Preferably in the preferred embodiment the barrier mounting may be rotatably mounted to other components of the gate opening system which in turn will allow it to rotate and pivot the barrier from an opened or closed, or closed to open positions.

Reference throughout this specification will also be made to the barrier mounting being employed to pivot the barrier to open or close same, but those skilled in the art should appreciate that other configurations for the invention are envisioned.

For example, in one alternative embodiment the barrier mounting may be adapted to lift the barrier out of the path of any vehicle wishing to pass the gate.

Preferably the energy transmission system employed may be adapted to rotate the drive element in one direction only when the barrier is to be opened.

Preferable the energy transmission system may receive energy from the weight of a vehicle depressing the portion of the system, where the force or energy transferred by the weight of the vehicle is in turn transmitted through the transmission system to rotate the drive element.

In a further preferred embodiment the portion of the energy transmission depressed by a vehicle may consist of a pressure pad or grating which is linked to a cable transmission system. Through depression of the entire pad, or alternatively the pivoting of one edge of the pad with respect to its opposite, the cable attached to the pad may be placed under tension to in turn place a pulling or turning force on the drive element.

Preferably the cable may be attached to the drive element via a lever arm which will place a torque or turning force on the drive element when the cable is tensioned. When the vehicle moves from the pressure pad or grate, tension on the cable will then be released and the turning force applied to the drive element will be removed.

Reference throughout this specification will also be made to the energy transmission system employing a pressure plate or gate connected to the drive element via a cable transmission system. However, those skilled in the art should appreciate that other configurations of the energy transmission system employed are also envisioned and reference to the above only throughout the specification should in no way be seen as limiting. For example in one alternative embodiment the cable system employed may be replaced by a hydraulic or pneumatic energy transmission system if required.

This configuration of the energy transmission system eliminates the need for the present invention to be connected to a remote source of energy such as mains power electrical transmission lines. The present invention need not also incorporate energy storage elements such as electrical batteries, which in turn must be recharged periodically if the gate opening system is to operate effectively. By employing the weight of a vehicle as the power source the system provided can be self-contained and therefore can provide significant advantages over the prior art when used in remote locations.

In a preferred embodiment a drive element may be formed from a substantially post like component with a circular cross-section and a hollow centre. Again however those skilled in the art should appreciate that a number of different types of shapes and configurations of drive elements may be employed in conjunction with the present invention, and references to the above only through the specification should in no way be seen as limiting.

In a preferred embodiment the drive element may include at least only lifting surface which has one end higher up the drive element post than the opposite end of the lifting surface. The barrier mounting or a portion thereof may be placed in contact with such a lifting surface or surfaces so that when the drive element is rotated, the portion of the barrier mounting in contact with the lifting surface will be forced upwards along the profile of a lifting surface as the drive element rotates.

The exact form or shape of a lifting surface employed within the drive element may vary substantially depending on the final design of the overall gate opening system. For example, in one preferred embodiment the lifting surface may be formed by a substantially straight angled place extending from the lower to the upper end of the surface. Alternatively in other embodiments the lifting surface may be formed as a gradual curve extending upwards, or for example, a series of small discrete steps which extend the lifting surface from its lower to upper end. Reference throughout this specification will also be made to the lifting surface being formed at a substantially angled straight surface but those skilled in the art should appreciate that other implementations of the surface are also envisioned.

In a preferred embodiment the barrier mounting may be formed from a substantially post shaped element with a circular cross section and hollow centre. This configuration of the invention allows the barrier mounting and drive element to be nested concentrically one within the other to provide a compact design. Furthermore by providing a circular cross section post this allows the barrier mounting and drive element to rotate freely with respect to one another.

In a preferred embodiment the barrier mounting may include a bearing surface which is adapted to engage with the lifting surface of the drive element. The bearing surface employed may present a profiled edge or projecting lug which engages with a lifting surface to in turn allow the lifting surface to bear and push against the barrier mounting. As the increasing height of the lifting surface rotates against the bearing surface it will place a lifting force on the bearing surface to in turn lift the barrier mounting.

Preferably the drive element may employ two distinct and separate lifting surfaces located on opposite sides of the drive element post. The provision of two lifting surfaces provides a balanced lifting force to the barrier mounting when the drive element is rotated. Reference throughout the specification will also be made to the drive element including two distinct lifting surfaces which work together to apply a lifting force to the barrier mounting when the drive element is rotated in a particular direction. However, those skilled in the art should appreciate that any number of lifting surfaces may be employed within the drive element and reference to the above only throughout the specification should in no way be seen as limiting.

In a preferred embodiment the barrier mounting may include two distinct and separate bearing surfaces located on opposite sides of the barrier mounting post. These two bearing surfaces may engage with the two lifting surfaces of the barrier mounting to ensure that the lifting forces are applied to the barrier mounting in a smooth and balanced way. Again however those skilled in the art should appreciate that any number bearing surfaces may be formed within a barrier mounting and reference to the above only throughout the specification should in no way be seen as limiting.

The shape, configuration or form of a bearing surface within the barrier mounting may also vary depending on the particular design or application for the gate opening system. For example in one embodiment a bearing surface may be formed by a lug which projects from the main surface of the barrier mounting into the open area above a lifting surface. Alternatively in other embodiments one edge or end of the barrier mounting may be cut into a series of angled profiled shapes which compliment the shapes of the lifting surface provided in the drive element. In such instances the bearing means may sit substantially on top of the drive element with one end of the bearing means providing an entire bearing surface against the correspondence lifting surfaces within the drive element.

Preferably the present invention may also include a central support post which is used to mount the drive element and barrier mounting post in place within the gate opening system. Such a support post may again be provided with a substantially circular cross section and may have a diameter that allows it to fit within the concentric nesting of the barrier mounting and drive element. The support post may be provided to give the gate opening system strength against lateral forces applied to it and may also be used to secure and mount other components of the system in place.

Reference through the specification will also be made to the gate opening system employing a support post located inside both the drive element and barrier mounting. However, those skilled in the art should appreciate that other configurations for the present invention are envisioned and reference to the above only throughout the specification should in no way be seen as limiting. For example, in one alterative embodiment an external covering or housing may be provided over the outside of both the barrier mounting and drive element to serve the same purpose as the support post discussed above.

Preferably once the barrier mounting's bearing surfaces are engaged with the upper region of the drive element's lifting surfaces the retention means provided will be disengaged, leaving the barrier free to swing open. The driving force for moving the barrier from the closed to opened position may be provided through gravitational potential energy stored within the lifted barrier mounting. Once the retention means has been released and the vehicle triggering the energy transmission system has moved off the pressure pad, this will allow the barrier mounting to slide downwards along the lifting surfaces and in turn being rotated as it falls. Rotation of the falling barrier mounting will in turn pivot the barrier from its closed to open position. In this situation the barrier Will be fully opened when the barrier mounting's bearing surfaces rest on the lower ends of the drive element lifting surfaces. At this stage, with the barrier open, the vehicle involved would be free to move past the gate without the vehicle's operator having to get out of the vehicle to open the gate.

Preferably the present invention may include a retention means which, as discussed above, can be employed to secure the barrier in an open and/or closed position. Those skilled in the art should appreciate that any number of different types of configurations of the retention means may be employed depending on the application for the present invention. For example a retention means employed as a farm gate to secure livestock will be different from a retention means employed in an urban setting which is adapted to prevent unauthorised entry to premises.

In a preferred embodiment the retention means may include a latch element located on the free end of the barrier. This latch element may engage with a vertical locating channel formed within a gate post or fencing component remote from the barrier mounted and associated drive element. The latch element may be located within such a vertical channel to prevent lateral or pivotal motion of the barrier when in a closed position. However as the barrier mounting is lifted this ill in turn lift the latch out of the locating channel and therefore disengage the retention means employed.

In a further preferred embodiment a return ramp may also be provided adjacent to the vertical locating channel. This return ramp may be used to guide the motion of the latch on the end of the barrier up towards and into the locating channel when the gate is returned from its open to closed position. The latching element may run up the surface of the return ramp and then drop into the locating channel to engage the retention means and hold the barrier in the closed position.

In a preferred embodiment the present invention may also include a return system which is adapted to move the barrier mounting and associated barrier from the closed to open positions without lifting the barrier mounting. Such a return system may apply a rotational force on to the drive element opposite to the rotational force applied by the energy transmission system. When the barrier mounting is in the open position its bearing surfaces will be located on the lower ends of the drive element lifting surfaces. As the return system's rotational force is in the opposite direction to that applied by the energy transmission system this force will simply induce a lateral rotational motion without lifting the barrier mounting up the lifting surfaces. This return force will then pivot the barrier mounting back to the closed position and therefore close the gate.

In a further preferred embodiment the return system may include an energy accumulator which is charged by the energy transmission system and the opening operations employed within the present invention. For example, in one preferred embodiment the return means may include an accumulator in the form of the gas strut which has its gas reservoir compressed. The strut's gas reservoir can be compressed through a driving piston being linked to the lever arm provided on the drive element for the energy transmission system to rotate the drive element. Rotation of this lever arm will in turn force the gas strut piston inwards to compress the gas contained in its reservoir. The compressed gas in this accumulator system may be contained by a control valve, and then allowed to expand again when required to place (via its piston) a return force on to the drive element.

Reference throughout the specification will also be made to a return system employed in conjunction with the present invention being provided with a gas strut accumulator system. However those skilled in the art should appreciate that other types of return system, and accumulators for return systems, are also envisioned and reference to and above only throughout the specification should in no way be seen as limiting.

In a further preferred embodiment the retention means may also include or provide the ability to retain the barrier in an opened position for a set period of time to allow a vehicle to pass safely through the opened gate. Additional components may be provided within the retention means to interact with the return system above to delay its operation and therefore delay the closing of the gate.

For example in a preferred embodiment a low power electronic control system and electrical battery may be employed to delay the operation of the return system. Alternatively, such timing systems may be provided though hydraulic means in the form of a bleed valve within the return system gas strut. This bleed valve may slow the rate of expansion of the gas within the return system strut to in turn slow the return of the barrier to its closed position. Alternatively, in yet another embodiment where the return system gas strut is linked to a lever arm on the barrier mounting, the retention system may include a hydraulic sub-system associated with the lever arm. This sub-system may be configured in the form of a hydraulic ram that incorporates a bleed valve. The ram may interfere with the movement of the lever arm until, after a sufficient delay period, the bleed valve allows enough fluid to exit the ram chamber to in turn allow the ram to move out of the way of the lever arm.

In yet another alternative embodiment these components of the retention means may be formed by mechanical elements which are wound up and charged through the opening operations of the gate. Such a mechanical timing system may wind down over a set period of time until a control level or switch is tripped to in turn allow the return system to operate.

According to a further aspect of the invention there is provided a gate assembly of a kind where a barrier member to act as a gate is carried at its proximate end by a barrier mounting, the assembly being characterised in that the barrier is moveable against a return bias under the action of a vehicle-provided weight and/or movement providing power input to a system adapted both to rotate at least part of the barrier mounting thereby to change the state of closure or openness of the gate of the gate assembly.

According to a further aspect of the invention there is provided a barrier opening system comprising or including:

a drive element which is rotatable about a substantially vertical axis (the "mounting axis");

a barrier mounting aligned substantially concentrically about the mounting axis which can rotate in relation to the drive element, a barrier attached to the barrier mounting, an actuation means attached to the drive element which can rotate the drive element between a first and a second condition, and a latch comprising or including a receiving member, and an engaging member wherein the receiving member is disengagable from said engaging member by upward motion of said engaging member, wherein the drive element and the barrier mounting interact via a camming arrangement, the camming arrangement comprising or including at least one upwardly sloping camming surface on or of the drive element about the mounting axis, and at least one cam follower moveable over at least part of the camming surface on the barrier mounting, and wherein in the first condition the cam follower rests at the bottom of the upwardly sloping camming surface and the barrier and barrier mount are in a first orientation, and in the second condition rotation of the drive element by the actuation means rotates the upwardly sloping camming surface which in turn creates an upward vertical motion of the barrier mount and in turn the barrier, sufficient to disengage either or both the barrier mount or the barrier from the latch attached thereto, and when the barrier mounting or the barrier is disengaged from the latch the at least one cam follower is free to move back down the at least one upwardly sloping camming surface under action of gravity and thence the barrier mounting and in turn the barrier, are moved to a second orientation.

According to a further aspect of the invention there is provided a gated opening in fencing characterised in that:

a vehicle actuable device both unlatches and rotates the gate reliant solely on the energy input from the vehicle's interaction with the device.

Preferably the rotation is against a return bias adapted to counter rotate the gate after a delay.

Preferably the device lifts the gate to achieve the unlatching.

Preferably the device includes a pressurised fluid and/or mechanical linkage to a gate lifting and rotating mechanism from an input pad upon which an actuating vehicle can act.

Preferably a biasing mechanism stores energy for a counter rotation of the gate, there being means to delay its effect.

The present invention may provide many potential advantages over the prior art.

The present invention allows an automatic gate opening system to be implemented with a simple design, and consequently at relatively low cost. The nature of the design employed in the present invention allows it to be located in remote regions as it does not need regular maintenance for its component.

Preferably the energy used to drive the gate opened and closed is sourced from the weight of a vehicle which is to pass through the gate. This allows the gate opening system to be implemented as an isolated and self contained system without the need for supply of energy from a remote source, or a source which would need frequent renewal.

BRIEF DESCRIPTION OF THE DRAWINGS

Further aspects of the present invention will become apparent from the following description that is given by way of example only and with reference to the accompanying drawings in which.

BEST MODES FOR CARRYING OUT THE INVENTION

Figure 1:
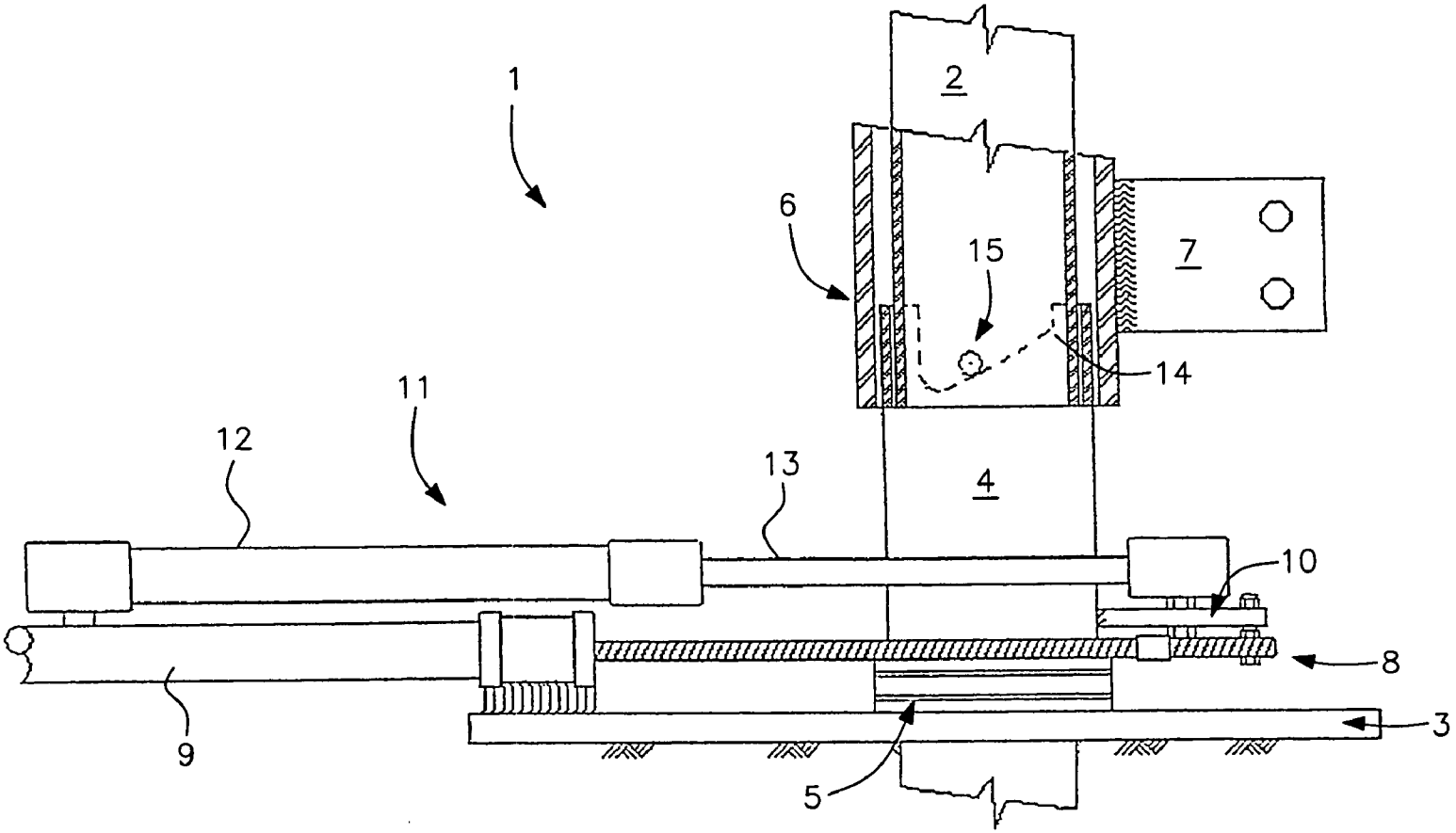
FIG. 1: shows a side cross section view of components of a gate opening system configured in accordance with a preferred embodiment of the present invention.

FIG. 1 shows a side cross sectional view of a gate opening system 1 configured in accordance with a preferred embodiment of the present invention. The system 1 employs a central support post 2 and a base plate 3 with the support post 2 being fixed directly to the base plate 3.

A drive element, shown in this embodiment in the form of a hollow circular cross section post 4 is rotatably mounted via bearing 5 to the base plate 3. The drive element post 4 surrounds the central support post 2, and is in turn surrounded by a barrier mounting 6 formed as a substantially circular hollow post. The barrier mounting 6 is welded to portions of a barrier 7 which extends out over an area to be closed or secured.

FIG. 1 also shows portions of an energy transmission system employed to apply a rotational force to the drive element 4. The energy transmission system incorporates transfer cable 8 with a protector sleeve 9 where the end of the cable 9 shown is connected to a lever arm 10 attached to the side of the drive element 4. The energy transmission system also includes a pressure plate or grate (not shown) which is connected to the opposite end of the cable 9 and which can be depressed by the weight of a vehicle pressing on same. A weight placed on the pressure plate will tension the cable 9 and pull the end of the lever arm 10 over to the left side of the page thereby rotating the drive element 4.

This rotational movement induced by the tension in the cable 9 will also load portions of a return system 11 formed by a gas strut 12 and associated driving piston 13. The free end of the driving piston 13 is attached again to the lever arm 10 so that when the drive element is rotated by the cable 9 this will also drive the piston 13 in towards the reservoir of the gas strut 12, and the compressed gas contained within the reservoir.

The upper portions of the drive element 4 are also formed to include a lifting surface 14 which has a lower end and an upper end. Engaging with the lifting surface 14 is a bearing surface 15 directly connected to the barrier mounting 6. The lifting surface 14 and bearing surface 15 work together to lift the barrier mounting 6 which the drive element 4 is rotated by the energy transmission system (not fully shown).

The function of the gate opening system 1 and the movements it executes to open and close a gate are shown more clearly in the progression of drawings provided with respect to FIGS. 2*a*, 2*b*, 3*a*, 3*b* and 4.

Figure 2A:
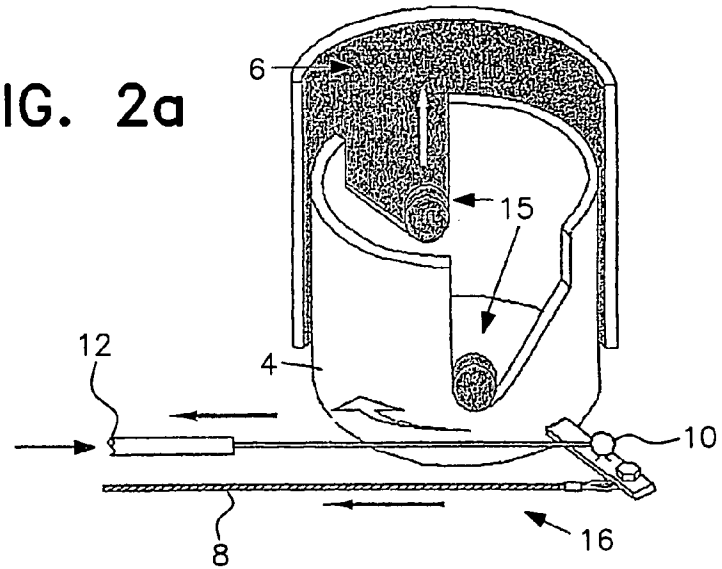
FIGS. 2*a* and 2*b*: show perspective cross section views of the same gate opening apparatus of FIG. 1 in the initial rest closed position.
Figure 2B:
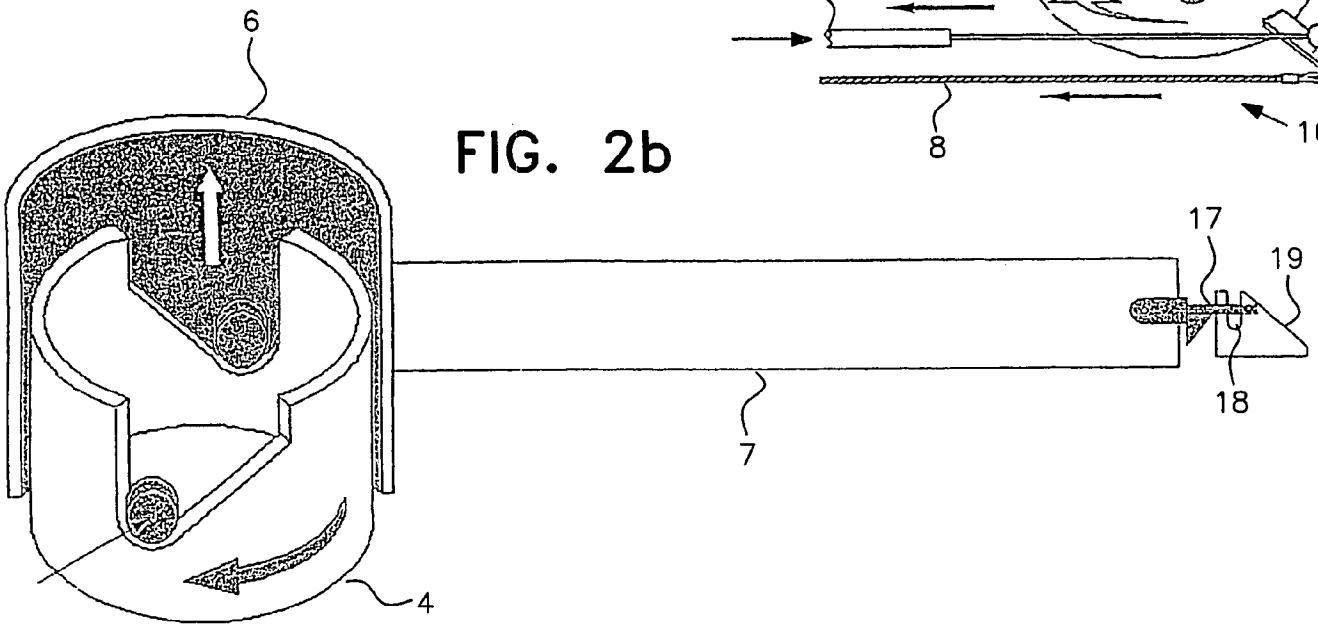

FIGS. 2*a* and 2*b* show the initial rest and closed position of the gate opening system. The bearing surface 15 of the barrier mounting 6 is in contact with the lower ends of the drive elements lifting surfaces 14.

When the cable 9 is tensioned this will apply a turning force via lever arm 10 to the drive element 4, thereby forcing the bearing surfaces 15 to slide up the lifting surfaces 14 and to lift the associated barrier mounting 6 upwards.

FIG. 2*b* also show components of a retention means 16 used to hold the barrier 7 securely in its closed position. The retention means includes a projecting latch element 17 attached to the free end of the barrier 7. When the retention means is engaged the latching element 17 fits within a vertical channel 18 formed within a component of a wall, fence or gate post opposite to the barrier mounting. The latch element 17 will hold the barrier in place within the channel 18 until the barrier mounting 6 is lifted upwards and hence the latch 17 clears the channel 18.

The retention means also includes a return ramp 19 which is used to guide the latch 17 back into the vertical slot 18 when the barrier is moved from its open to closed position. As can be appreciated by those skilled in the art the ramp and vertical channel portions shown have been rotated through 90° from the normal positions to clearly illustrate the features of the retention means employed.

Figure 3A:
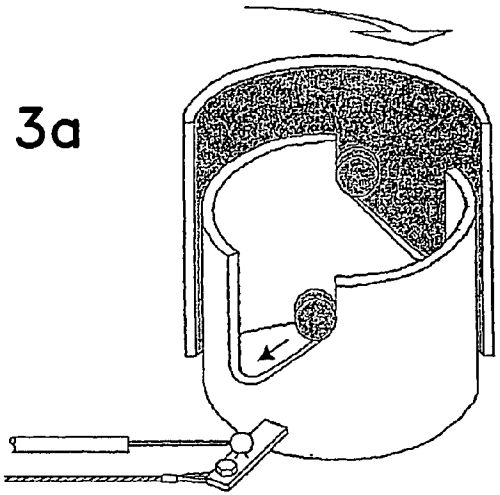
FIGS. 3*a* and 3*b* show perspective cross views of the same gate opening apparatus of FIG. 1 when the barrier mounting has been lifted by the tensioning of the transmission cable.
Figure 3B:
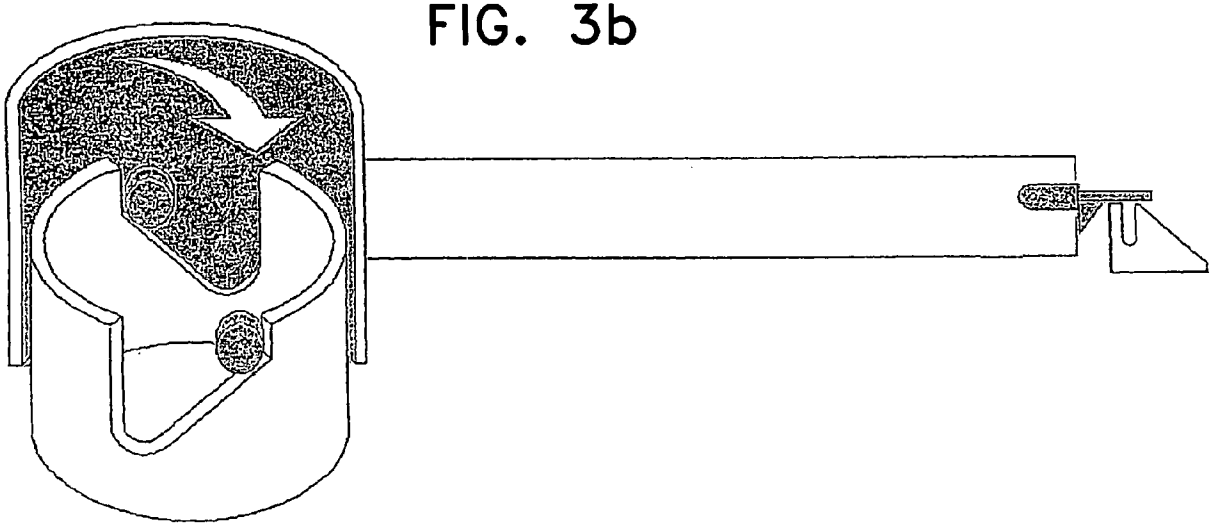

FIGS. 3*a* and 3*b* show the configuration of the system when the barrier mounting has been lifted by the tensioning of the energy transmission cable. As can be seen from FIG. 3*a* the bearing surface now sits on the upper or top portion of the drive element's lifting surface and the barrier mounting has been lifted through the height of the lifting surface.

At this point in the operation of the system the retention means is disengaged, as shown with respect to FIG. 3*b*. The latch element is lifted out of the vertical channel, allowing the barrier to pivot freely to an open position.

Once the retention means has been disengaged the barrier mounting and associated bearing surfaces are free to slide down the lifting surfaces, to drop the height of the barrier mounting and in turn to rotate the barrier mounting to open the barrier.

Figure 4:
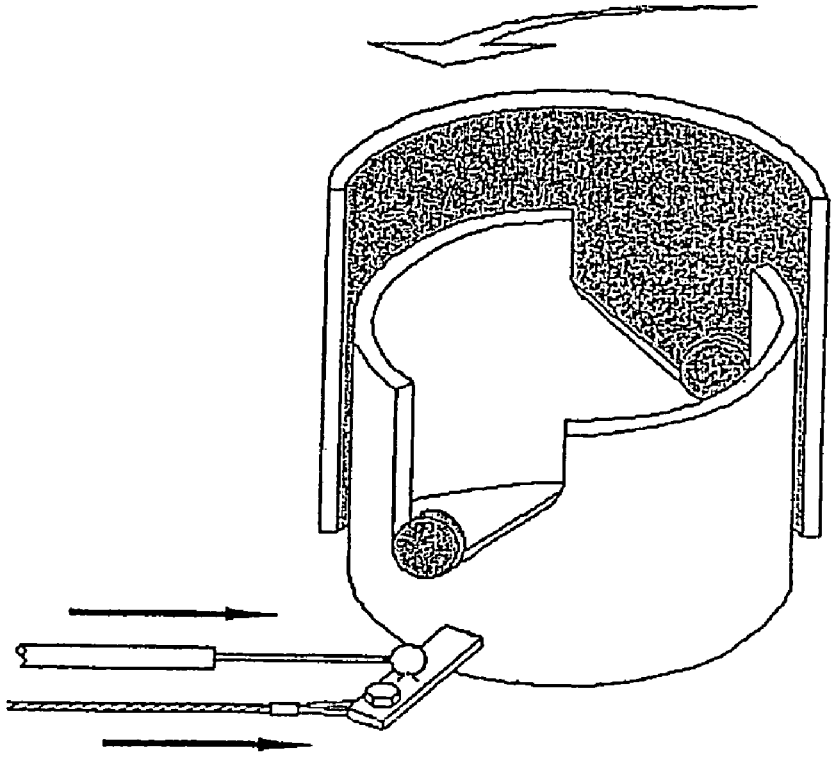
FIG 4. shows a perspective cross section view of the same gate opening apparatus of FIG. 1 when the return system, after a delay, closes the gate.

The final resting position of the barrier mounting is shown with respect to FIG. 4 where the barrier is placed in an open position.

FIG. 4 also shows the forces to be applied by the return system of the present invention after a delay period allowing a vehicle to pass through the gate provided. At this stage there is no tension on the cable, while the driving piston can apply a driving force through the release of the compressed gas contained within the gas strut. This force applied by the return system will place a direct lateral turning force on each of the bearing surfaces to simply turn and pivot the barrier support without lifting it. The pivoting, of the barrier support will in turn pivot the attached barrier back into its closed position, with the ramp of the retention means guiding the latch element back into the vertical channel to again engage the retention means and hold the barrier in its closed position.

Aspects of the present invention have been described by the way of example only and it should be appreciated that modifications and additions may be made thereto without departing from the scope thereof.

I claim:

1. A gate opening system comprising:

a barrier mounting adapted to support a barrier for a movement between an open condition and a closed condition, a retention means for securing the barrier in the closed condition, a drive element, and an actuator, the barrier mounting including a substantially post shaped element with a circular cross section and hollow center, allowing the barrier mounting and drive element to be nested concentrically one within the other and to allow the barrier mounting and drive element to rotate freely with respect to one another, the barrier mounting including bearing surfaces adapted to engage with lifting surfaces of the drive element, the bearing surfaces including projecting lugs engaging with the lifting surfaces to allow the lifting surfaces to bear and push against the barrier mounting, the drive element including said lifting surfaces disposed on opposite sides of the drive element to provide a balanced lifting force to the barrier mounting when the drive element is rotated, wherein the actuator is adapted to apply a rotational force to the drive element causing the barrier mounting to the first be lifted, disengaging the retension means so that the bearing surface and lifting surfaces then cooperate to rotate the barrier mounting.

2. The gate opening system as claimed in claim 1, wherein the projecting lugs project from the barrier mounting into open areas above the lifting surfaces.

3. The gate opening system as claimed in claim 2, further comprising a central support post used to mount the drive element and barrier mounting.

4. The gate opening system as claimed in claim 3, wherein the support post is provided with a substantially circular cross section and has a diameter allowing the support post to fit within the concentric nesting of the barrier mounting and drive element.

5. The gate opening system as claimed in claim 1, wherein the lifting surface are a series of angled profiled shapes.

* * * * *